US006474233B1

(12) United States Patent
Kosciesza et al.

(10) Patent No.: US 6,474,233 B1
(45) Date of Patent: Nov. 5, 2002

(54) INK-SUPPLY DEVICE OF A PRINTING-MACHINE INKING UNIT

(75) Inventors: Hary Kosciesza, Borchen; Renko Möllers, Sassenberg, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/449,711

(22) Filed: Nov. 24, 1999

(30) Foreign Application Priority Data

Nov. 25, 1998 (DE) ..... 198 54 494

(51) Int. Cl.[7] ..... B41F 31/00
(52) U.S. Cl. ..... 101/335; 101/366
(58) Field of Search ..... 101/366, 295, 101/202–210, 300–305, 307–315, 318–321, 323–326, 329–331, 337–365, 367

(56) References Cited

U.S. PATENT DOCUMENTS 2,065,279 A * 12/1936 Kline ..... 101/366
2,890,652 A * 6/1959 Jauch et al. ..... 101/122
3,065,886 A * 11/1962 Smalley, Jr. ..... 222/400.7
3,099,211 A * 7/1963 Hilgoe et al. ..... 101/366
3,199,451 A * 8/1965 Nitchie ..... 101/366
3,929,071 A * 12/1975 Cialone et al. ..... 101/335
4,535,693 A * 8/1985 Belvederi ..... 101/366
4,787,313 A 11/1988 Osborn et al.
5,724,890 A * 3/1998 Deschner et al. ..... 101/366
5,813,339 A * 9/1998 Schmitt et al. ..... 101/335
5,878,667 A * 3/1999 Ryan ..... 101/366
5,921,181 A * 7/1999 Ritter ..... 101/366
5,947,022 A * 9/1999 Freeman et al. ..... 101/123
6,067,906 A * 5/2000 Ryan et al. ..... 101/335
6,085,652 A * 7/2000 Deschner et al. ..... 101/366

* cited by examiner

*Primary Examiner*—Eugene H. Eickholt
(74) *Attorney, Agent, or Firm*—Laurence A. Greenberg; Werner H. Stemer; Gregory L. Mayback

(57) ABSTRACT

An ink-supply device of a printing-machine inking unit, having a pressure discharge device, and a lid provided in the pressure discharge device for closing one of a cartridge holder for accepting a cartridge, and a cartridge received directly in the pressure discharge device, respectively, an internal space being formed in one of the pressure discharge device and in a region located between the cartridge and the lid, respectively, the internal space being subjectible to an application of compressed air via a flow path provided with a valve, includes a setting device for actuating the valve when one of the cartridge holder and the cartridge, respectively, is closed by the lid; and a printing machine including the ink-supply device.

11 Claims, 12 Drawing Sheets

INK-SUPPLY DEVICE OF A PRINTING-MACHINE INKING UNIT

BACKGROUND OF THE INVENTION

Field of the Invention

The invention relates to an ink-supply device of a printing-machine inking unit, having a pressure discharge device including a cartridge holder for accepting a cartridge, the cartridge holder having a lid for closing the cartridge holder, the pressure discharge device being formed with an internal space subjectible to an application of compressed air to be applied to an internal space of the pressure discharge device via a flow path provided with a valve.

Devices of this general type having a cartridge as an ink reservoir are particularly advantageous if only very small quantities of a respective printing ink are used for specific print jobs. Pressure discharge units wherein the cartridge is pressed out by compressed air are very user-friendly.

The device described in the published European Patent Document EP 0 716 923 A1 includes a pressure discharge unit having a cylinder housing and a cover cap. A cartridge is insertable into the cylinder housing. The cylinder housing can be closed by screwing the cover cap there. Besides this specific screw connection, no other specific rotary joints, such as, a so-called wrench or twist (Renk) joint, for example, are described. Closing the cylinder housing by a general type of rotary joint, is likewise not mentioned. An interior space of the cover cap can have compressed air applied thereto via a manually actuatable valve which, for this purpose, is provided with a switch knob. The valve is not a multiway valve and has only a single flow path. No adjusting device for actuating the valve when the cylinder housing is closed by the lid is provided. Although the device is more user-friendly when compared with pressure discharge units constructed as handlever presses, because it requires no expenditure of force by the user in order to press out the cartridge, the operational reliability thereof is inadequate. On the one hand, inadvertent actuation of the switch knob and unintentionally leaving the compressed-air feed open are also possible when the cylinder housing has not been closed and when no cartridge has been inserted into the cylinder housing. The situation is therefore not ruled out wherein compressed air can continue to flow out of a pressure discharge unit even though the latter should actually be inactive, which may consequently cause pressure losses in the overall compressed-air system. On the other hand, one may forget to open the valve of an actually active pressure discharge unit when a cartridge is inserted into the cylinder housing. Operating faults of this type are often not noticed immediately, so that after the printing operation has been started, rejects are printed which have a printed image wherein the printing ink from the cartridge that is actually active but does not have compressed air applied thereto, and is therefore not pressed out, is lacking.

Furthermore, a device is described in the published German Patent Document DE 196 32 717 A1, wherein a cartridge can be inserted into a tubular housing. A fitted cap with a compressed-air connection can be set onto the tubular housing and locked on the housing by a bayonet lock-type mechanism.

SUMMARY OF THE INVENTION

It is accordingly an object of the invention to provide an ink-supply device of a printing-machine inking unit that can be operated more reliably than heretofore known devices of this general type.

With the foregoing and other objects in view, there is provided, in accordance with one aspect of the invention, an ink-supply device of a printing-machine inking unit, having a pressure discharge device, and a lid provided in the pressure discharge device for closing one of a cartridge holder for accepting a cartridge, and a cartridge received directly in the pressure discharge device, respectively, an internal space being formed in one of the pressure discharge device and in a region located between the cartridge and the lid, respectively, the internal space being subjectible to an application of compressed air via a flow path provided with a valve, comprising a setting device for actuating the valve when one of the cartridge holder and the cartridge, respectively, is closed by the lid.

In accordance with another aspect of the invention, there is provided an ink-supply device of a printing-machine inking unit, having a pressure discharge device including a cartridge holder for accepting a cartridge, the cartridge holder having a lid for closing the cartridge holder, the pressure discharge device being formed with an internal space subjectible to an application of compressed air to be applied to the internal space of the pressure discharge device via a flow path provided with a valve, comprising a setting device for actuating the valve when the cartridge holder is closed by the lid.

In accordance with a further aspect of the invention, there is provided an ink-supply device of a printing-machine inking unit, having a pressure discharge device for accepting a cartridge, the pressure discharge device having a lid for closing the cartridge directly, compressed air being applicable via a flow path provided with a valve to an internal space defined by the cartridge and the lid, comprising a setting device for actuating the valve when the cartridge is closed by the lid.

In accordance with an additional feature of the invention, the one of the cartridge holder and the cartridge, respectively, is constructed so to be closed by the lid via a releasable rotary joint, the valve being actuatable via the setting device when the rotary joint is rotated.

In accordance with an added feature of the invention, the rotary joint is a so-called wrench joint.

In accordance with another feature of the invention, the valve is a multiway valve switchable by the setting device into a first switching position and a second switching position.

In accordance with a further feature of the invention, the lid has a rotatable lid disk that is a bayonet disk forming the wrench joint and provided with so-called wrench elements.

In accordance with yet another feature of the invention, the ink-supply device includes a venting device for venting the internal space in a third rotary position of the rotary joint, that is located between a first rotary position "completely joined" and a second rotary position "released", while the rotary joint has not yet been released.

In accordance with yet a further feature of the invention, the ink-supply device includes a safety device for preventing the rotary joint from being rotated from the third rotary position into the second rotary position for as long as the internal space remains at excess pressure.

In accordance with yet an added feature of the invention, the ink-supply device includes an air pressure-sensitive sensor for signalling a presence of excess pressure in the internal space to an electronic control device.

In accordance with yet an additional feature of the invention, the ink-supply device includes an electric switch for signalling an actual switching position of the valve to an electronic control device.

In accordance with still another feature of the invention, the electric switch is actuatable by the setting device for actuating the valve.

In accordance with still a further feature of the invention, the ink-supply device includes a locking device for blocking rotation of the rotary joint when there is no cartridge in the cartridge holder, and for releasing rotation of the rotary joint when a cartridge is accommodated in the cartridge holder.

In accordance with a concomitant aspect of the invention, there is provided a printing machine including at least one ink-supply device having at least one of the foregoing features.

Thus, the ink-supply device of a printing-machine inking unit, having a pressure discharge device, including a cartridge holder for accepting a cartridge, and a lid for closing the cartridge holder, compressed air being applicable to an internal space of the pressure discharge device via a flow path provided with a valve, is distinguished by the valve being actuatable via a setting or adjusting device when the cartridge holder is closed by the lid.

An alternative thereto is an ink-supply device of a printing-machine inking unit, having a pressure discharge device provided with a lid for closing a cartridge directly, compressed air being applicable to an internal space defined by the cartridge and the lid, via a flow path provided with a valve, and the valve being actuatable via a setting or adjusting device when the cartridge is closed by the lid.

In the latter ink-supply device, during the closing operation, the lid is placed directly onto the cartridge instead of onto the cartridge holder and, for example, is screwed to the cartridge or preferably joined therewith via a wrench joint. For this configuration, cartridges can be used which are provided with threads or equipped with wrench elements. The joining or connecting elements are preferably formed close to the edge at ends of the cartridge remote from the pressure discharge opening, on the outside or inside of the tubular cartridge.

Embodiments described hereinbelow, respectively, permit a particularly advantageous development of the afore-described ink-supply device according to the invention.

In one embodiment, the cartridge holder and the cartridge, respectively, can be formed so as to be closed by the lid via a releasable rotary joint, the valve being actuatable via a setting or adjusting device when the rotary joint is rotated.

Any outflow of compressed air from the inactive pressure discharge device is absolutely reliably avoided. The setting or adjusting device can actuate the valve so that the compressed-air feed to the internal space is shut off when the cartridge holder is opened, and the compressed-air feed is released when the cartridge holder is closed. The valve is preferably switchable mechanically by the setting or adjusting device, in that the setting device displaces or rotates an adjusting element of the valve, for example, an adjusting push-button, due to which the valve is switched.

Assurance is thereby provided that the valve is automatically driven correctly as a function of the rotary position of the rotary joint. When the rotary joint is unscrewed and screwed tightly, the valve can be switched, respectively, in the opposite direction. When the rotary joint is released, the compressed-air feed can be interrupted by the valve, so that the inadvertent outflow of compressed air is absolutely reliably prevented. When the rotary joint is closed, the valve, in this case, releases the compressed-air feed, so that the readiness of the pressure discharge device to operate is ensured. An unclosed lid is additionally detectable more easily by the operator, in comparison with an unpressed switch knob, so that the operator can make the system ready to operate in good time, for example, by closing the cartridge holder and producing the rotary joint, before the operator begins the printing operation.

In a further embodiment, the rotary joint is a wrench joint. The wrench joint catches formlockingly by the twisting or rotation of the entire lid and a rotatable part of the lid, respectably, and the cartridge holder and a rotatable part of the cartridge holder, respectively, in one another. In this regard, it is noted that a formlocking connection is one which connects two elements together due to the shape of the elements themselves, as opposed to a forcelocking connection, which locks the elements together by force external to the elements. Preferably, a rotatable part of the lid is rotated while the cartridge holder is fixed. The wrench joint can be frictionally locking and formlocking, the force required for the frictional connection between the participating wrench elements becoming effective due to an elastic deformation of components, for example, a resilient sealing ring inserted between the lid and the cartridge holder and sealing off the internal space, or due to a deformation of the lid and the cartridge holder itself, respectively. The wrench joint holds the cartridge holder closed in a very reliable manner.

In a further embodiment, the valve is a multiway valve which can be switched into a first switching position and a second switching position by the setting or adjusting device.

In addition to the application of compressed air, the multiway valve likewise permits venting of the internal space, the application of compressed air and the venting being able to take place via different flow paths in the valve. Depending upon the switching position, assurance is provided that the internal space either has compressed air applied thereto or is vented, and is never simultaneously acted upon by compressed air and vented. In addition to the increased operating reliability, the outlay or expense for production is reduced, because an additional venting device separate from the valve is not required.

In a further embodiment, the lid has a rotatable lid disk that is a bayonet disk forming the wrench joint and provided with wrench elements.

In this regard, the wrench joint is formed as a flange-like wrench pair similar to the bayonet fittings which are conventional for joining photographic cameras to interchangeable lenses. In contrast with a screw joint, the bayonet joint can be released rapidly and rejoined again, by rotating the bayonet disk.

In a further embodiment, in a third rotary position of the rotary joint, located between a first rotary position "completely joined" and a second rotary position "released", the internal space is vented by a venting device while the rotary joint has yet not been released.

The venting device permits the internal space to be vented, the positive or excess pressure being dissipated in the second position before the cartridge holder and the cartridge, respectively, have been completely opened. In this manner, the abrupt escape of the compressed air and, consequently, any possibility of the already completely released lid being thrown off by compressed air, is avoided. The venting preferably occurs via the valve which, in this case, is part of the venting device. A safety device which, for example, depending upon the pressed air, locks the rotary joint, can in this case ensure that the rotary joint be rotatable from the third rotary position (middle position) into the released, second rotary position only after the internal space has been completely vented.

In a further embodiment, a sensor sensitive to air pressure is provided for signalling positive or excess pressure in the internal space to an electronic control device.

Through the intermediary of the sensor, a message can be sent to the electronic control device, so that the latter receives a signal that the valve has been opened and a cartridge has been inserted into the cartridge holder, and thus the system is made ready to operate. The internal space is partly formed and bounded, respectively, by the cartridge, it being possible for positive or excess pressure, which can be registered directly by the sensor, to build up in the internal space only when the cartridge has been accepted properly by the cartridge holder, and the latter has been closed by the lid.

In a further embodiment, an electric switch is provided, which signals the actual or current switching position of the valve to an electronic control device.

The electric switch can be provided in addition to the sensor sensitive to air pressure or, preferably, instead of the sensor sensitive to air pressure. The switch informs the control device whether the valve is opened or closed.

In a further embodiment of the invention, the electric switch is actuated by the setting or adjusting device actuating the valve.

By actuating the valve and the switch by way of a common setting or adjusting device, if the sensor sensitive to air pressure is not present, assurance can be provided that a feedback regarding the correct application of compressed air to the internal space is transmitted to the control device. The application of compressed air to the internal space is thereby registered indirectly via the switching position of the valve.

In a further embodiment, rotation of the rotary joint is blocked by a locking device if there is no cartridge in the cartridge holder, and is released when a cartridge is accommodated in the cartridge holder.

Consequently, the lid and the cartridge holder can be joined only when a cartridge has been inserted properly into the cartridge holder. The case wherein no cartridge has been inserted into the cartridge holder, or a cartridge has been inserted into the cartridge holder improperly, and the pressure discharge device is thus not closed, is readily apparent to the operator. In such a case, the operator can take the necessary countermeasures before spoilage or rejects are produced.

The ink-supply device according to the invention can be used in sheet-fed and web-fed rotary printing machines, which can operate, for example, in the letterpress or offset-printing process.

Other features which are considered as characteristic for the invention are set forth in the appended claims.

Although the invention is illustrated and described herein as embodied in an ink-supply device of a printing-machine inking unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
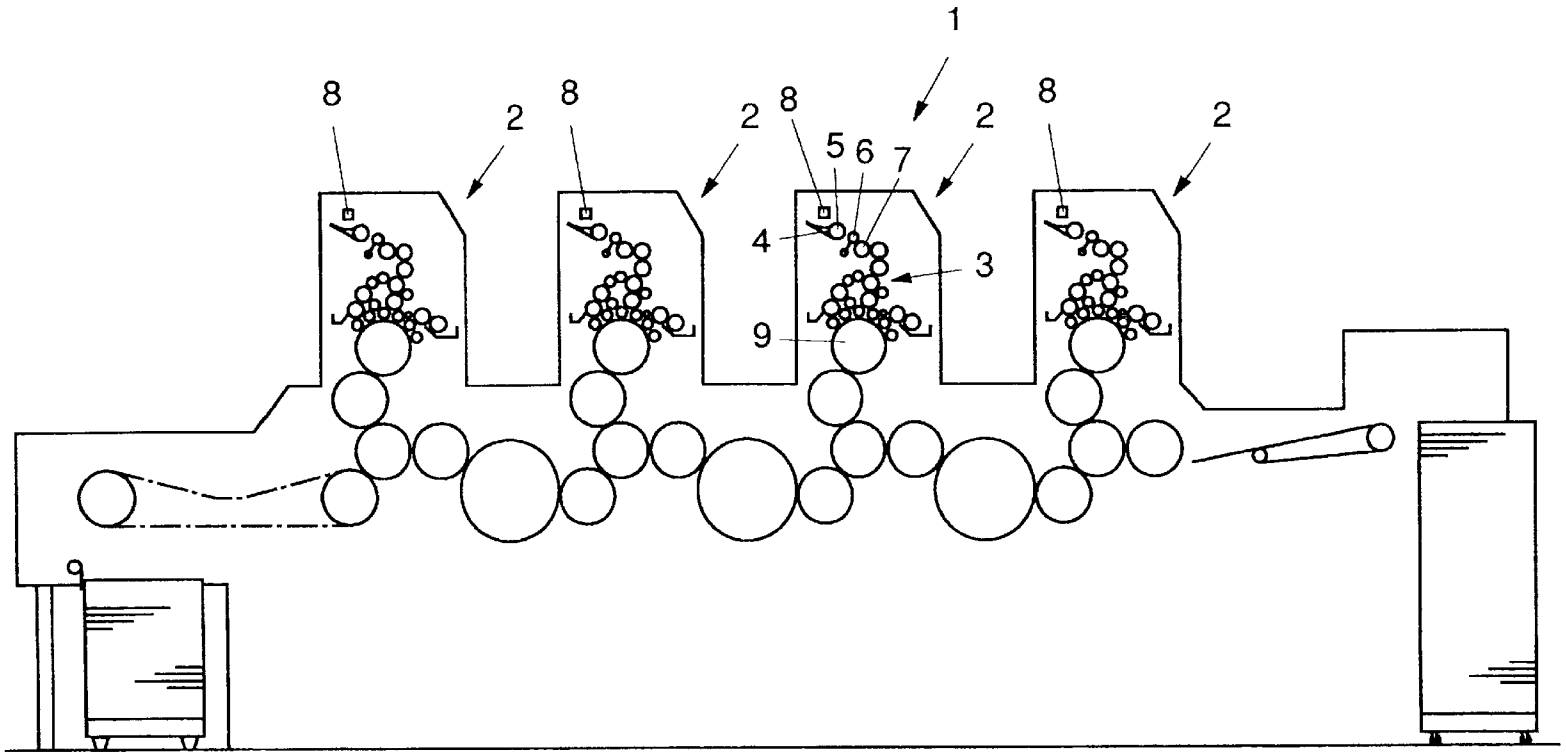
FIG. 1 is a diagrammatic side elevational view of a printing machine having a plurality of ink-supply devices according to the invention.

In the figures, identical parts are identified by like reference numerals, respectively.

Referring now more specifically to the figures of the drawings, there is shown therein in FIG. 1, a printing machine 1 having a plurality of printing units 2. The printing machine 1 is constructed as a rotary offset printing machine for printing sheets of printing material. Each printing unit 2 includes an inking unit 3 that transports printing ink to a printing-form cylinder 9 and applies the ink to a printing form disposed on the printing-form cylinder 9. The inking unit has a plurality of inking-unit rollers 5, 6 and 7, the inking-unit roller 5 being an ink-fountain or ink-duct roller belonging to an ink fountain 4. The printing ink is fed to the inking-unit roller 5 by an ink-supply device 8. The inking-unit roller 7 is formed as a distributor roller that oscillates in the axial direction thereof. The inking-unit roller 6 is formed as a vibrator roller that swings reciprocatingly between or to and from the inking-unit rollers 5 and 7, making contact with the latter from time to time, and in so doing transferring the printing ink from the inking-unit roller 5 onto the inking-unit roller 7. The electronic control device 10 comprises a microprocessor and controls the printing machine 1 and the ink-supply device 8.

Figure 2:
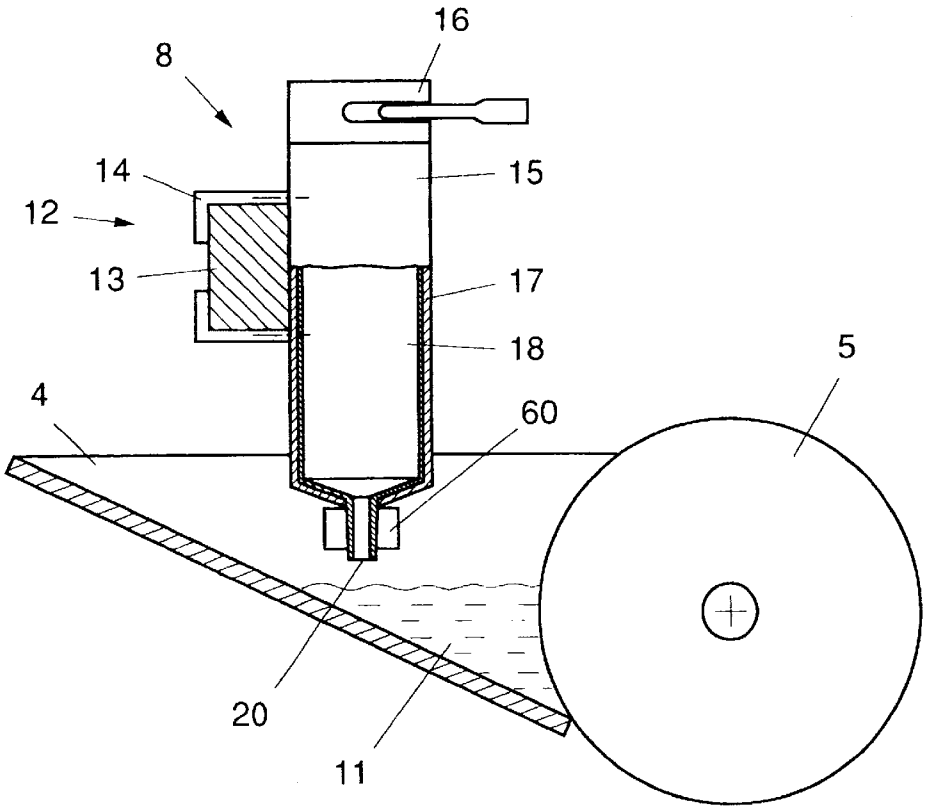
FIG. 2 is an enlarged fragmentary view, partly in section, of FIG.1 showing one of the ink-supply devices of the printing machine.

FIG. 2 illustrates the ink fountain 4 and the ink-supply device 8 in detail. The ink-supply device 8 comprises a pressure discharge device 15 that is movable in a direction parallel to the axis of the inking-unit roller 5, guided by a guide 12, so that a metered discharge of ink is possible from a cartridge 18 contained in the pressure discharge device 15, the metered discharge corresponding to the ink demand in the individual inking zones over the entire printing width, which essentially corresponds to the axial length of the inking-unit roller 5. The printing ink is preferably discharged from the cartridge 18 into the ink fountain 4. In this case, the opening 20 of the cartridge 18 is located above the ink fountain 4. Alternatively, the opening 20 can also be disposed above the inking-unit roller 5, so that a stream of ink pressed out of the cartridge 18 passes directly onto the peripheral outer surface of the inking-unit roller 5. The guide 12 is formed of a crossmember or traverse 13, on which the pressure discharge device 15 is mounted so that it can be displaced in directions parallel to the axis of the Inking-unit roller 5. For this purpose, the pressure discharge device 15 can be carried by a carriage rolling on the rail-like crossmember 13. Instead of the carriage, a slide 14 sliding on the crossmember 13 can also be provided, as is shown in FIG. 2. The crossmember 13 extends over the entire axial length of the inking-unit roller 5. The pressure discharge device 15 includes a cartridge holder 17, in which the cartridge 18 is insertable. Furthermore, the pressure discharge device 15 includes a lid 16, with which the cartridge holder 17 can be closed after the cartridge 18 has been inserted. Through the intermediary of a valve 60 that is assigned to an outlet opening of the cartridge holder 17 or, as shown, to the cartridge 18, the printing ink in the cartridge 18 can be stopped from running out of the outlet 20 of the cartridge 18 or the outlet opening of the cartridge holder 17, and the metered discharge of ink from the pressure discharge device 15 can be controlled.

Figure 3:
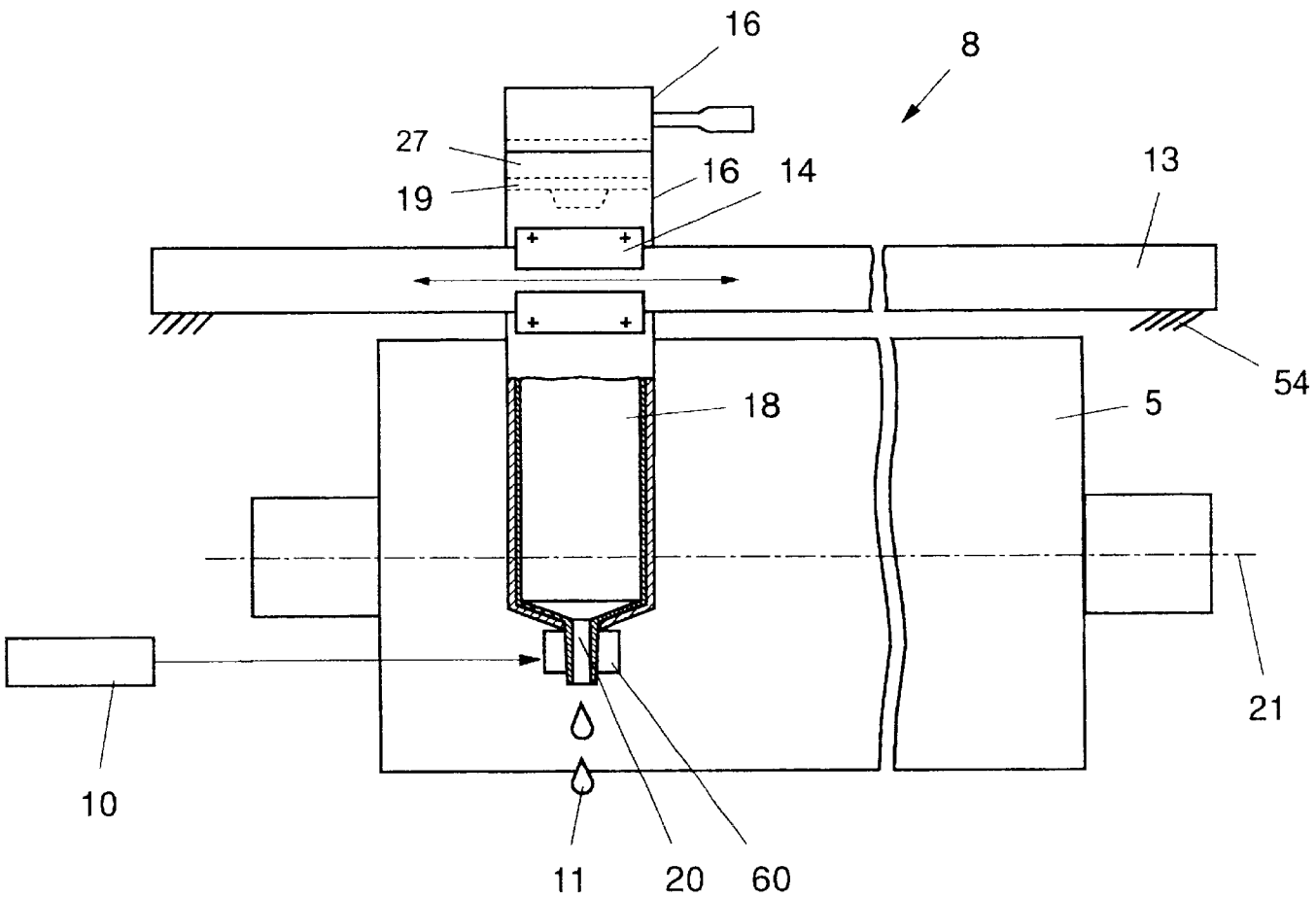
FIG. 3 is a front elevational view of FIG. 2, as seen from the lefthand side of the latter figure.

FIG. 3 shows the device of FIG. 2 in a front view, as seen from the lefthand side of FIG. 2, the ink fountain 4 and the supply of printing ink 11 therein being omitted from FIG. 3 in the interest of improved clarity. The crossmember 13 is mounted in a diagrammatically illustrated frame 54 of the inking unit 3. The hollow cylindrical cartridge 18 has a bottom 19, shown in dotted lines, that is displaceable in the cartridge 18 and, together with the lid 16 and the inner walls of the cartridge 18, bounds and encloses an internal space 27. The internal space 27 is an expansion chamber to which compressed air can be applied. When compressed air is applied to the internal space 27, the bottom 19 is displaced in the manner of a piston in a direction towards the outlet 20, as a result of which the printing ink 11 in the cartridge 18 is pressed out of the cartridge 18, when the valve 60 is open. During the operation of the ink-supply device 8, a permanent positive or excess pressure prevails in the internal space 27, and the quantity of printing ink 11 emerging from the cartridge 18 can be controlled, timely and spatially, by an electronic control device 10 that drives or controls the outlet valve 60. When the cartridge 18 is displaced parallel to the axis of the inking-unit roller 5, the valve 60 can be opened and closed appropriately within each inking zone as a function of or in accordance with the ink demand and a set zonal ink profile.

Figure 4:
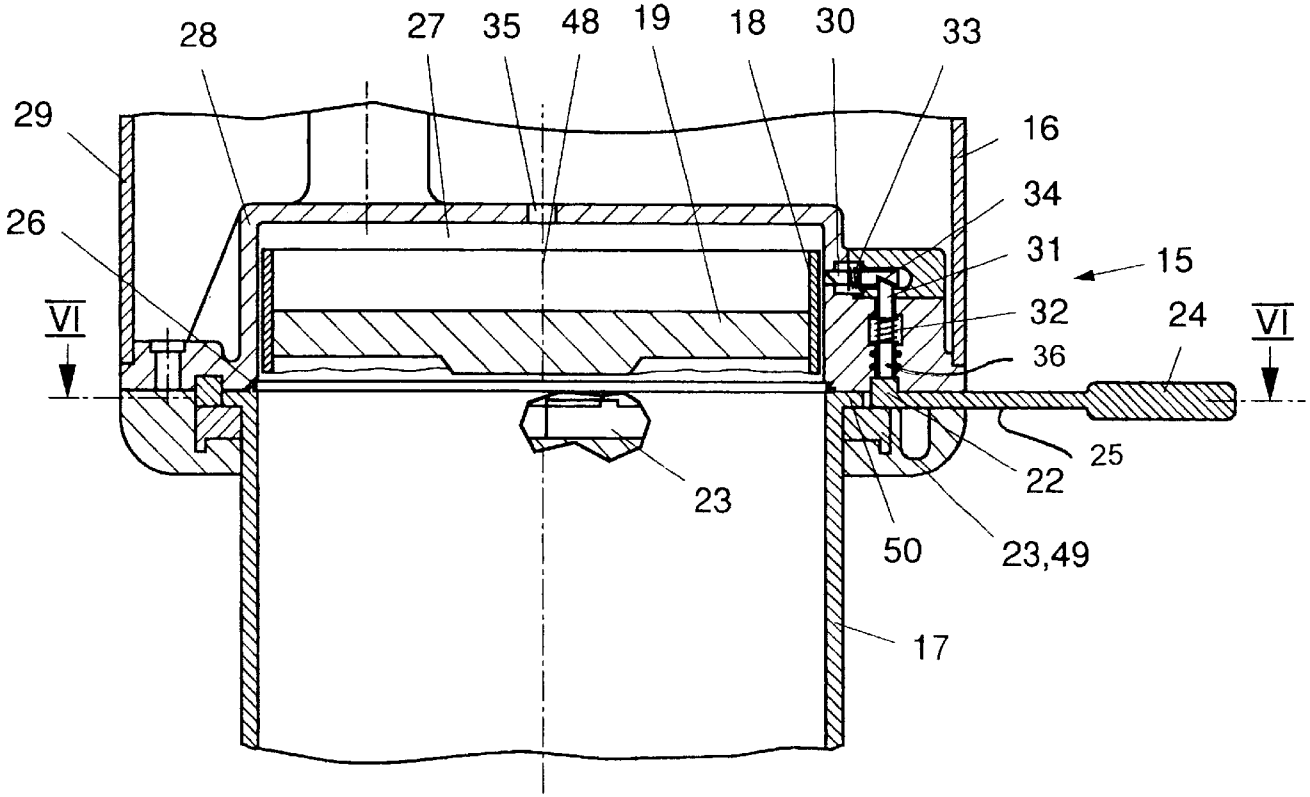
FIG. 4 is a longitudinal sectional view of a pressure discharge device of the ink-supply device in an operating phase wherein a cartridge has been inserted into the pressure discharge device.

FIG. 4 shows that the cartridge holder 17 is constructed so that it can be closed by the lid 16 via a releasable rotary connection or joint 49, 50, the valve 41 (see FIGS. 7, 8, 9, 11) being actuated automatically via an adjusting or setting device, including a lid dish 22 and a plunger 36 (see FIG. 7), when the rotary joint 49, 50 is rotated. The releasable rotary joint 49, 50 is formed as a so-called wrench joint and specifically as a bayonet joint. The lid 16 is multipartite and includes an inner cover cap 28, and an outer cover cap 29 connected to the inner cover cap 28 and slipped over and enclosing the inner cover cap 28. Both the outer cover cap 29, forming an outer part, and the inner cover cap 28, forming an inner part and closing off the internal space 27 at the top, are pot-shaped, respectively. The lid 16 includes at least one and preferably several rotatable lid disks 22, 23. The lid disk 22, which can be rotated by a lever-like handle 24, is an annular control or setting disk, by which the rotary joint 49, 50 can alternatively be set into a first rotary position, in which the lid 16 is joined to the cartridge holder 17, and into a second rotary position, in which the joint between the lid 16 and the cartridge holder 17 is released. The handle 24 extends out of the lid 16 through a slit-like opening 2S formed in the latter and through the outer cover cap 29. The other rotatable lid disk 23 is an annular bayonet disk forming the wrench joint 49, 50, provided with wrench elements 49, the bayonet disk being corotated with the setting disk 22 when the latter is rotated. The cartridge holder 17 is provided with wrench elements 50 which form the wrench joint 49, 50 and cooperate with the wrench elements 49 of the bayonet disk 23. If the cartridge 18 is not inserted into the cartridge holder 17 at all, or is not inserted correctly in the position illustrated in FIG. 4, rotation of the rotary joint 49, 50 is blocked by a locking device 30, 31. When the cartridge 18 is correctly accommodated in the cartridge holder 17, the locking and blocking, respectively, are neutralized or cancelled. The rotary joint 49, 50 can be set alternatively into a first rotary position, in which the lid 16 is joined to the cartridge holder 17, and into a second rotary position, in which the joint or connection between the lid 16 and the cartridge holder 17 is released. The locking device 30, 31 includes two displaceable plungers 30 and 31 and is arranged on the lid 16. When the lid 16 is placed on the cartridge holder 17 with the cartridge 18 inserted in the cartridge holder 17, that end of the cartridge 18 which projects from the cartridge holder 17 is pushed into the lid 16 and, in so doing, strikes the first plunger 30. The first plunger 30 is pushed by the cartridge 18 from a first plunger position into a second plunger position. In the process, a notch-like partial latching seat 34 of the first plunger 30 (see FIG. 5) comes into alignment with the second plunger 31, which is arranged at an angle to the axis, preferably at right angles to the latter, so that the second plunger 31 can latch as a latching part into the partial latching seat 34. The plungers 30 and 31 are sprung by springs 33 and 32, respectively, which reset the plungers 30 and 31. The spring 32 presses the plunger 31 into the latching position thereof, a beveled end of the plunger 31 latching into the partial latching seat 34 that has a corresponding shape. The beveled end of the plunger 31 and the partial latching seat 34 form a positive alignment latching mechanism that possesses a pairing of shapes which acts to block any displacement of the plunger 30 in a direction of motion. When one end of the plunger 31 is latched into the partial latching seat 34, the other end of the plunger 31 enables a movement of the setting disk 22, by the plunger 31 being lifted out of the locking position by the spring 32 and being lifted out of a recess 53 (note FIG. 5). The spring 33 forces the plunger 30 into the first plunger position shown in FIG. 5, wherein the end of the plunger 30, that is likewise beveled, projects into the interior of the lid, so that the cartridge 18 can actuate the plunger 30, in the manner of a thrust wedge, counter to the action of the spring 33. The spring 33 is constructed and dimensioned so that the spring 33, upon an appropriate cooperation, in the manner of a thrust wedge, between the partial latching seat 34 and the beveled end of the plunger 31, is capable of pushing the plunger 31 out of the latching position in the plunger 32 counter to the weaker force of the spring 32, and setting it into the locking position. This occurs only if the plunger 30 senses that there is no cartridge 18 in the cartridge holder 17, i.e., if no cartridge 18 is present in the cartridge holder 17 or if the lid 16 has not been placed on the cartridge holder 17 and the cartridge 18 projecting out of the latter. The spring 32 presses or forces the plunger 31 into the latching position thereof in the plunger 30, so that the rotary joint 49, 50 is unlocked. The setting disk 22 belonging to the setting device 22, 36, and the bayonet disk 23 are coupled to one another mechanically. This can be achieved by the lid disks 22 and 23 being fastened to one another or by the disks being made of one piece, forming a single disk with a complex cross-sectional geometry. The rotary joint 49, 50 is blocked, the setting disk 22 being blocked directly by the second plunger 31 and, consequently, the bayonet disk 23 being blocked indirectly. The internal space 27 is sealed off by the annular seal 26 located between the lid 16 and the cartridge holder 17. Compressed air can be supplied to the internal space 27 via an inlet 35.

Figure 5:
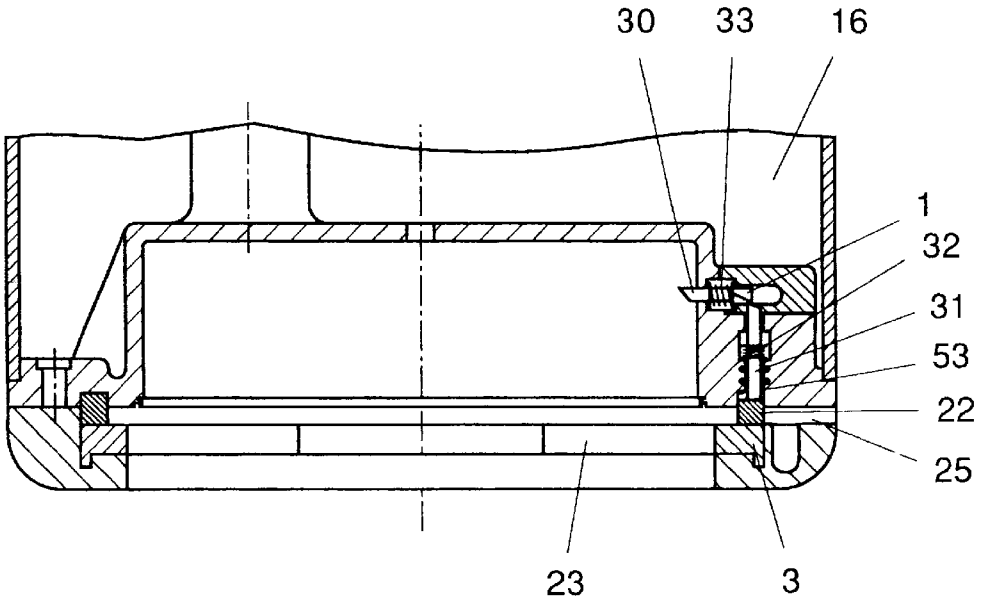
FIG. 5 is another view of FIG. 4, showing only a lid of the pressure discharge device in another operating phase thereof, after the cartridge has been removed.

In FIG. 5, the lid 16 is illustrated as being separated from the cartridge holder 17. In the operating phase shown, no cartridge 18 presses or forces the plunger 30 away in the lid 16, so that the plunger 30 is positioned in the cartridge insertion path by the spring 33, which has a spring force that is coordinated with that of the spring 32 that displaces the plunger 31, via the plunger 30 and counter to the action of the spring 32, into the blocking position, in which the plunger 31 engages in the recess 53 formed in the setting disk 22 and blocks the setting disk 22 against rotation. As an alternative to the recess 53, a projection can be provided on the setting disk 22 and, when the setting disk 22 is rotated, the projection strikes the plunger 31 that is located in the blocking position and is in the way of the projection.

Figure 6:
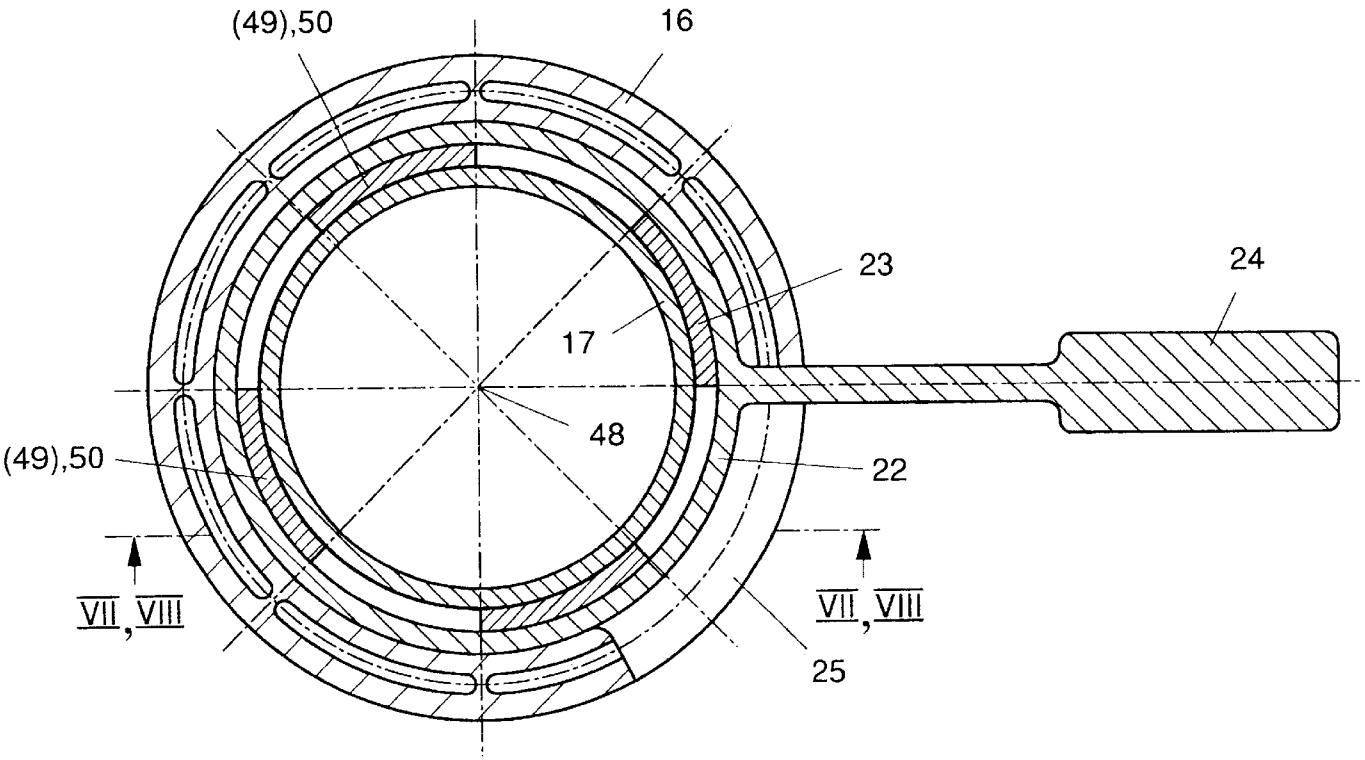
FIG. 6 is a sectional view of FIG. 4 taken along the line VI—VI in the direction of the arrows, the section line being at a connection location between a cartridge holder and the lid of the pressure discharge device, at an operating phase after the cartridge has been removed.

In FIG. 6, the rotary joint 49, 50 shown in FIG. 4 is illustrated in section from a view directed in the pressure-discharge direction.

The wrench elements 49 of the lid 16 and of the bayonet disk 23, respectively, are not visible because they are not in the plane of the section line. For a better understanding of the functioning of the wrench joint 49, 50, reference is made to the diagrammatic view of FIG. 12.

Figure 7:
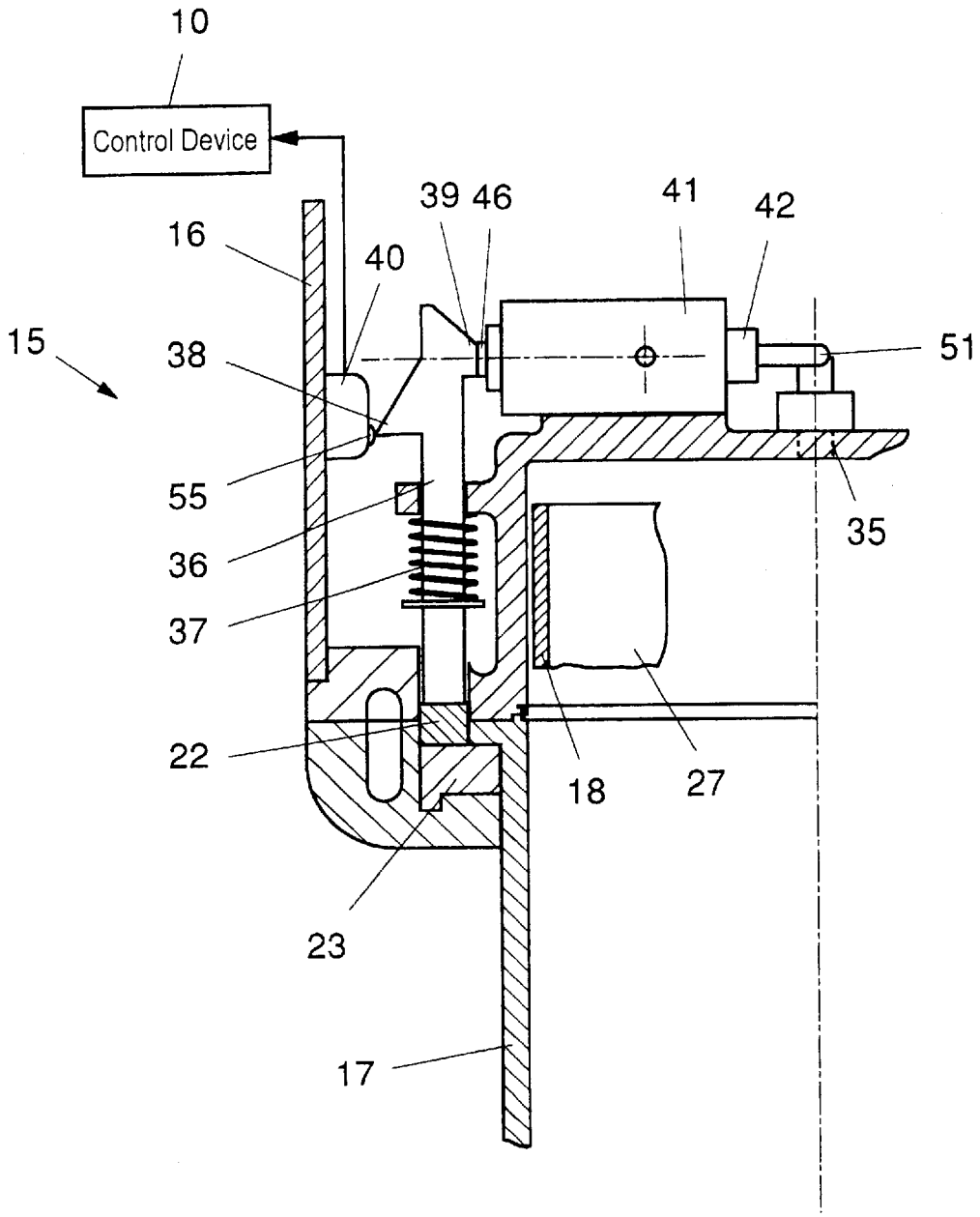
FIG. 7 is an enlarged fragmentary longitudinal sectional view of FIG. 6 taken along the line VII—VII in the direction of the arrows, and showing the pressure discharge device with an adjusting device for actuating a switch and opening a valve.

FIG. 7 illustrates a different sectional plane of the pressure discharge device 15 than that shown in FIGS. 4 and 6. When the rotary joint 49, 50 is rotated, the valve 41 is actuated automatically by the setting device 22, 36. The valve 41 can be switched alternatively into a first switching position and into a second switching position by the setting device 22, 36, and is constructed as a multiway valve. In the first switching position of the valve 41, the interior space 27 of the pressure discharge device 15 can have compressed air applied thereto from a compressed-air source 45 (note FIG. 9) and, in the second switching position, the flow of applied compressed air is shut off by the valve 41. In the second switching position, the interior space 27 of the pressure discharge device 15 is vented via the valve 41 when the rotary joint 49, 50 is in a third rotary position. The third rotary position is located between the first rotary position and the second rotary position of the rotary joint 49, 50, the internal space 27 being vented in the third rotary position by a venting device 22, 36, 41 while the rotary joint 49, 50 is not yet released, i.e., is not yet completely released. Thus, in the venting phase, the lid 16 is firmly connected formlockingly to the cartridge holder 17, so that the lid 16 is secured absolutely against being thrown off by the escaping air. In this regard, it is noted that a formlocking connection is one which connects two elements together due to the shape of the elements themselves, as opposed to a forcelocking connection, which locks the elements together by force external to the elements. The venting device 22, 36, 41 includes the valve 41 and the setting device 22, 36, the setting device 22, 36 serving to actuate the valve 41 in the third rotary position of the rotary joint 49, 50 and moving the valve 41 into the second switching position of the valve 41, wherein the internal space 27 is vented via the valve 41. The pressure discharge device 15 has at least one signal transmitter 40 that signals an electronic control device 10 of the printing machine 1 whether the pressure discharge device 15 has been made ready to operate or not. The signal transmitter 40 can be an electric switch 40 that is preferably formed as a microswitch arranged in the interior of the lid. The electric switch 40 is actuatable so that it is coupled to the valve 41 and signals to the electronic control device 10 the current switching position of the valve 41 and whether the rotary joint or connection 49, 50 has been formed and the pressure discharge device 15 has been closed, respectively, and thus the presence of the cartridge 18 in the pressure discharge device 15. The valve 41 is likewise arranged in the interior of the lid and is preferably seated on the inner cover flap 28. The valve 41 has a connection 42 which, when compressed air is applied to the internal space 27, is an outlet-side connection of the valve 41, and during the venting of the internal space 27 is an inlet-side connection of the valve 41. The connection 42 is connected to an opening which opens into the internal space 27 and forms the inlet 35 via the line 51 that forms a flow path for the compressed air. The electric switch 40 is actuated by the setting device 22, 36 which actuates the valve 41. For this purpose, the plunger 36 is mounted in the lid 16 so that it can be displaced by the setting disk 22 counter to the action of the spring 37. In an annular section that is assigned to the plunger 36, the setting disk 22 has a thickness which differs from the normal disk thickness. In this region, the thickness of the setting disk 22 can increase slowly, for example like an inclined plane, or can increase abruptly, for example like a protruding cam. The end of the plunger 36 that is actuated by the setting disk 22 is appropriately matched to the shape of the setting disk 22 and, for example, is rounded off or beveled. The switch 40 and the valve 41 are arranged opposite one another, it being possible for the plunger 36 to be pushed into the region between the switch 40 and the valve 41. The plunger 36 has two projections or protrusions 38 and 39, each of which cooperates with respective setting push-buttons 55 and 46 of the switch 40 and of the valve 41, the setting push-buttons 46 and 55 preferably being pressed or displaced approximately simultaneously by the plunger 36 when the latter is pushed into the position illustrated in FIG. 7. In this position, the plunger 36 holds the valve 41, counter to the action of a spring 56 (note FIG. 9), in the first switching position, wherein the internal space 27 can have compressed air applied thereto via the valve 41. The setting push-button 55 of the switch 40 is held pressed at the same time by the plunger 36.

The function or operation illustrated in FIG. 7 takes place as follows: with the cartridge 18 present in the cartridge holder 17, the locking device 30, 31 (FIG. 4) releases the joining or connection of the rotary joint 49, 50 and does not block it. When the rotary joint or connection 49, 50 is completely formed and the cartridge holder 17 is closed by the lid 16, the setting device 22, 36 is activated, opens the valve 41 and actuates the electric switch 40. The signal output by the switch 40 indicates to the electronic control device 41 that the device is ready to operate.

Figure 8:
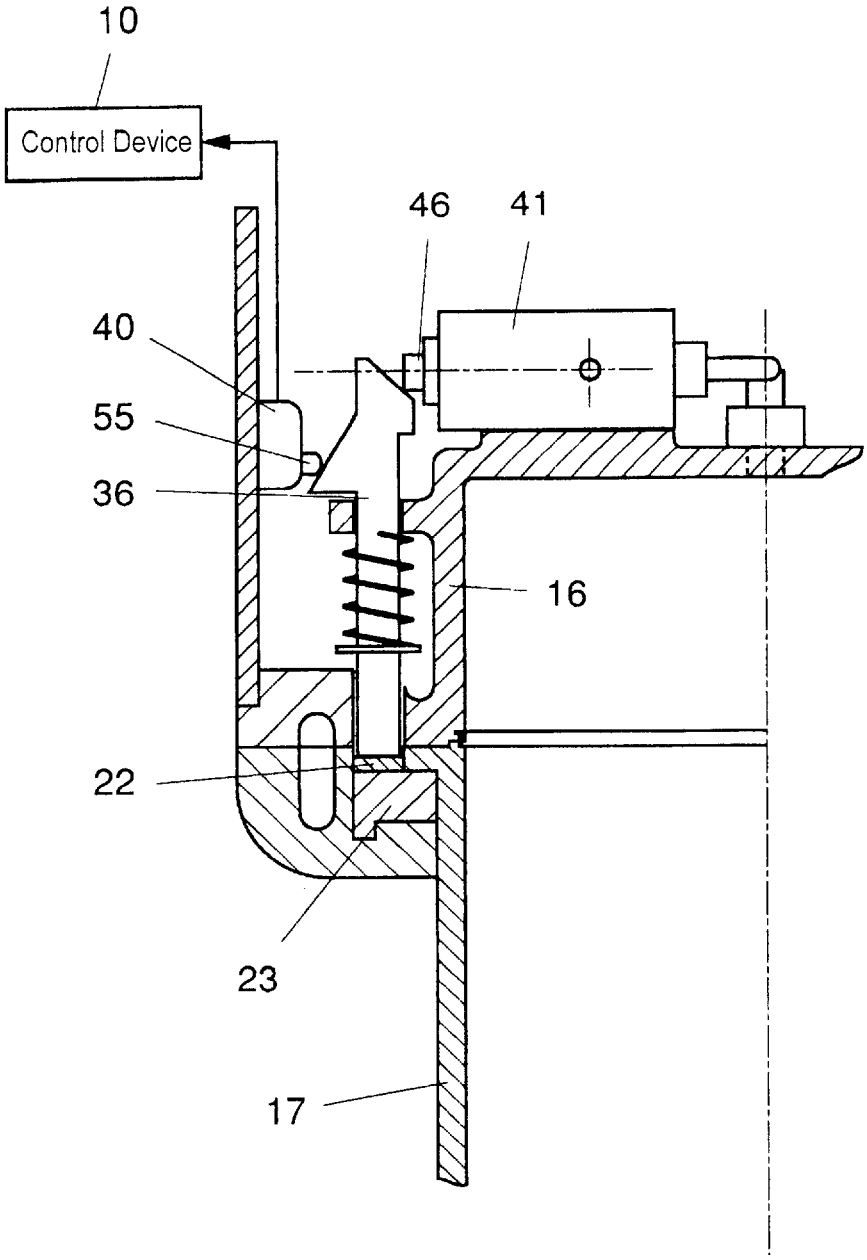
FIG. 8 is another view like that of FIG. 7, taken along the line VIII—VIII in FIG. 6, wherein the adjusting device is in another phase position thereof in which the switch has not been actuated and the valve is closed.
Figure 9:
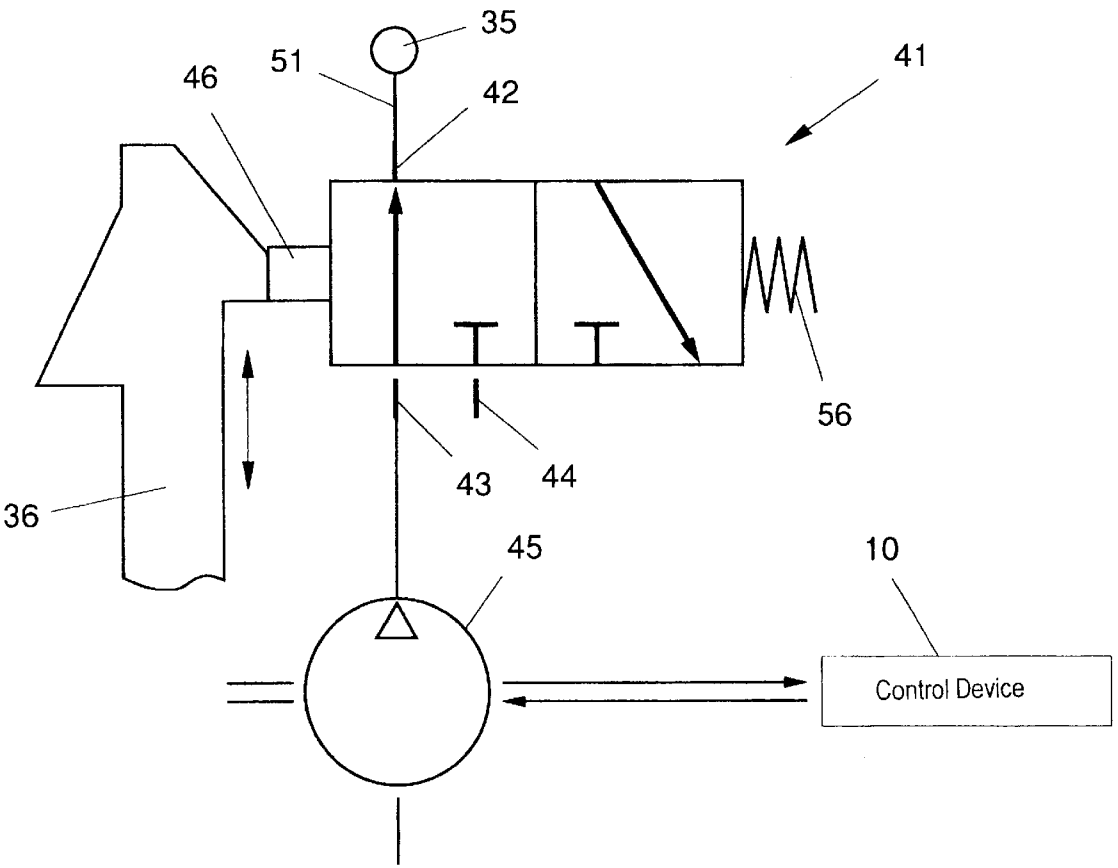
FIG. 9 is an enlarged, fragmentary diagrammatic and schematic view of FIG. 8, showing the valve constructed as a multiway valve.

In FIG. 8, the plunger 36 is illustrated in the position thereof reset by the spring 37. A comparison between FIG. 8 and FIG. 7 shows the difference in thickness between those sections of the setting disk 22 which, respectively, cooperate with the plunger 36. Also shown therein is that the push-button 55 of the switch 40 and the push-button 46 of the valve 41 are not actuated when the plunger 36 is retracted. The pressure discharge device 15 is illustrated in FIG. 8 in an operating phase wherein the cartridge holder 17 is not closed by the lid 16 via the releasable rotary joint 49, 50. FIG. 8 reveals the following function of the pressure discharge device 15: no cartridge 18 has been inserted into the pressure discharge device 15, so that it is therefore not possible to form the rotary joint 49, 50 completely, nor to activate the setting device 22, 36 blocked by the locking device 30, 31. The setting device 22, 36 thus neither opens the valve 41 nor actuates the electric switch 40, so that the internal space 27 does not have compressed air applied thereto, and the electronic control device 10 also does not receive any signal which indicates the readiness of the device to operate. The valve 41 actuated by the setting device 22, 36 is illustrated schematically and diagrammatically in FIG. 9. The valve 41 is a so-called 3/2-way valve which can be switched into two switching positions and is provided with three connections. The valve 41 has two flow paths. A first flow path leads from the connection 43 to the connection 42 and is open in the first switching position of the valve 41, as shown. In the first switching position, this flow path is used to apply the compressed air to the internal space 27, which can be supplied with compressed air by the compressed-air source 45, for example, a compressor or a compressed-air system of the printing machine 1, via the valve 41. In the first switching position, a second flow path from the connection 42 to the connection 44 is blocked. While compressed air is being applied to the internal space 27, the valve 41 is held by the setting device 22, 36 counter to the action of the spring 56. When the setting device 22, 36 is appropriately reset, the spring 56 moves the valve 41 from the first into a second switching position. In the second switching position, the flow path existing between the connections 42 and 43 is blocked and the flow path existing between the connections 42 and 44 is open. Venting of the internal space 27 takes place in that the positive or excess pressure present in the internal space 27 can escape via the flow path leading from the connection 42 to the connection 44.

In the first switching position, the connection 43 is thus an inlet-side connection of the valve 41, and the connection 42 is an outlet-side connection of the valve 41. In the second switching position, i.e., during venting, the connection 42 is therefore an inlet-side connection of the valve 41 and the connection 44 is an outlet-side connection of the valve 41. The compressed-air source 45 is driven or controlled by the electronic control device 10 and, for example, is activated only when the pressure discharge device 15 has been made ready to operate, a fact which is reported by the electric switch 40 and/or a sensor 52 (note FIG. 10).

Figure 10:
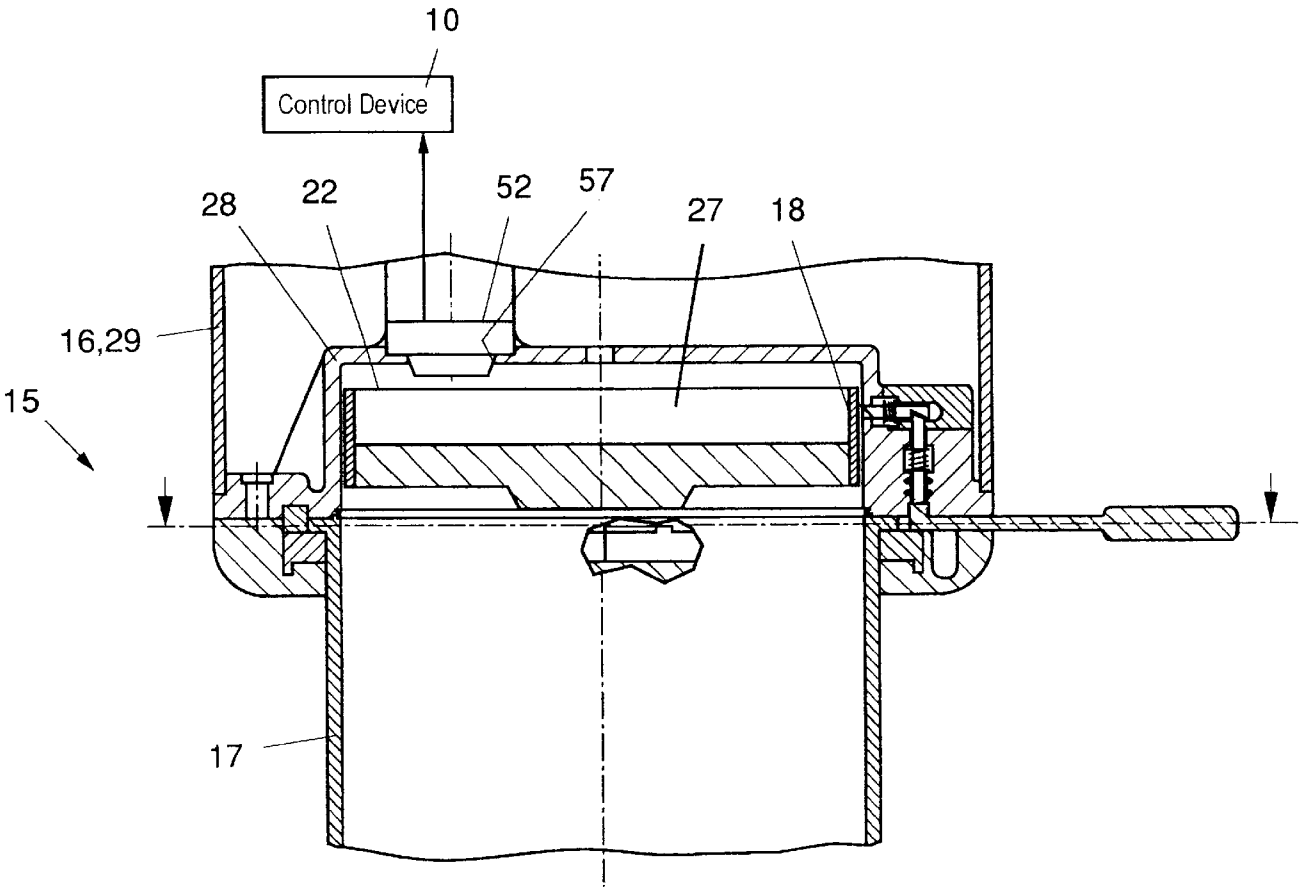
FIG. 10 is another view like that of FIG. 4, wherein the pressure discharge device is shown provided with an additional sensor that is sensitive to air pressure.

FIG. 10 illustrates the pressure discharge device 15 in a view corresponding to that of FIG. 4. In addition or preferably as an alternative to the electric switch 40 (FIG. 7), a sensor 52 sensitive to air pressure can be provided, which signals to the electronic control device 10 the presence or absence of a positive or excess pressure in the internal space 27. The sensor 52 is integrated in the lid 16 in a manner that the sensor 52 is exposed to the air pressure prevailing in the internal space 27 when compressed air is applied, and can be actuated by the compressed air. The sensor 52 shown is arranged in the interior of the lid and integrated in the internal cover cap 28. The lid 16 or the internal cover cap 28 is formed with a recess 57 wherein the sensor 52 is seated. The sensor 52 signals to the electronic control device 10 when there is a specific positive or excess pressure in the internal space 27. For the specific positive or excess pressure, a limiting value can be defined, at which the sensor 52 responds. The specific positive or excess pressure can build up in the internal space 27 only when the valve 41 has opened correctly and the cartridge 18 has been inserted correctly into the pressure discharge device 15. Once these preconditions have been fulfilled, the electronic control device 10 receives a signal from the sensor 52 that the pressure discharge device 15 has been made ready to operate.

Figure 11:
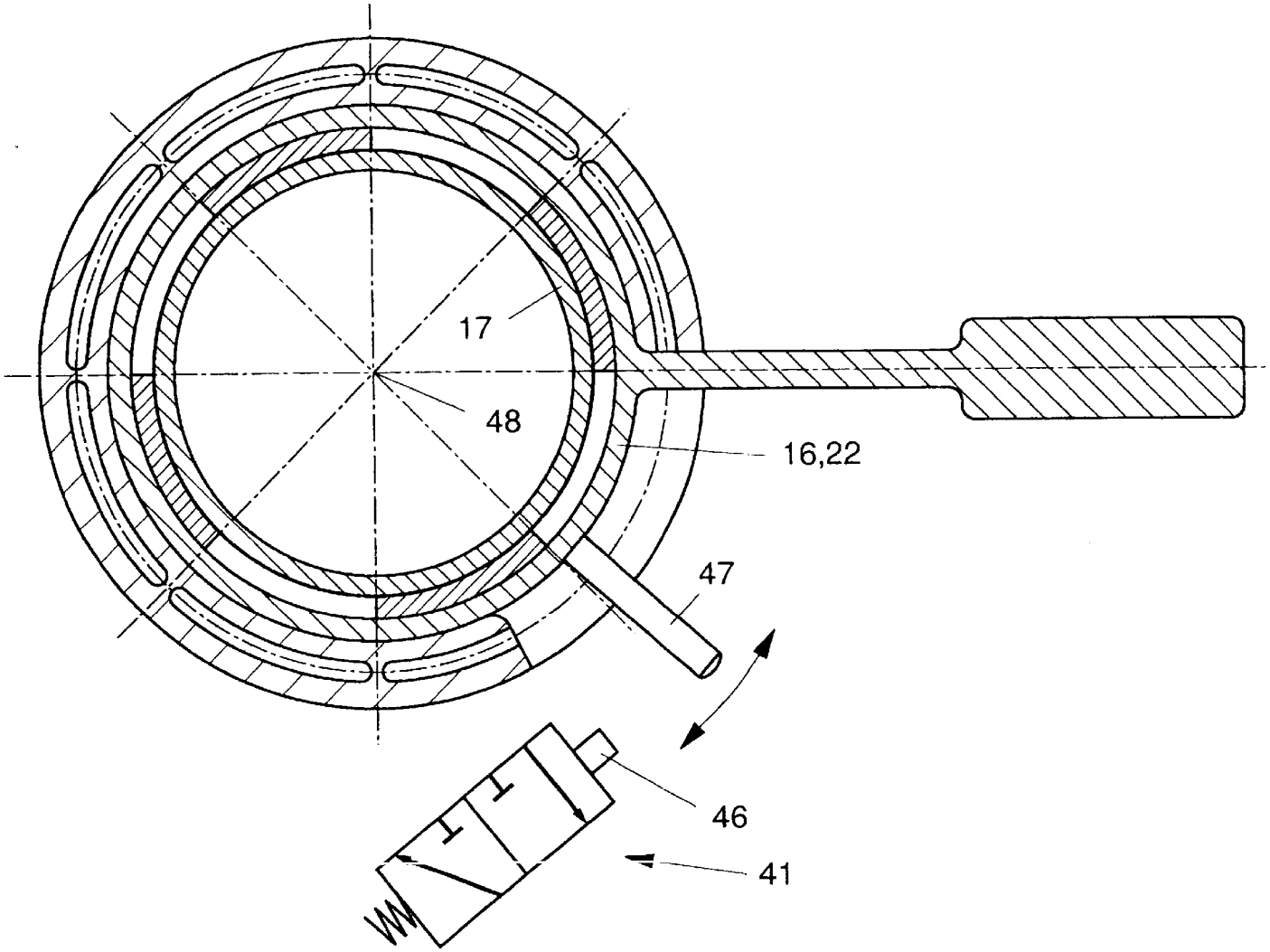
FIG. 11 is a view like that of FIG. 6 of the pressure discharge device, including a different adjusting or setting device for actuating the valve, the adjusting or setting device being preferably used together with the air pressure-sensitive sensor.

FIG. 11 illustrates a view, corresponding to that of FIG. 6, of the ink-supply device 8. The device illustrated in FIG. 11 has a modification when compared with the aforedescribed device embodiments illustrated in FIGS. 2 to 10. The modification is that the setting device 22, 36 has been replaced by the setting device 47 shown in FIG. 11. The setting device 47 is a setting or adjusting element formed as a protrusion, and secured to the lid 16 and preferably to the setting disk 22. The protrusion 47 actuates the valve 41 by setting the valve 41, via the setting push-button 46, into the corresponding switching positions. Instead of the displaceable setting element formed as the plunger 36 in the aforedescribed embodiments, in the case of the embodiment shown in FIG. 11, respective pivotable and rotatable setting elements are provided. The protrusion 47, which can be formed as a cam or, as shown, as a finger, is pivotable about the axis of rotation 48 of the rotary joint 49, 50 due to rotation of the rotary joint 49, 50. The valve 41 can be arranged on the carriage or slide 14 or preferably on the cartridge holder 17, and can be firmly connected to the corresponding component. However, the valve 41 can also be arranged on the lid 16 in a manner similar to that shown in FIGS. 7 and 9. In this case, the protrusion 47 can be oriented in the direction of the interior of the lid.

Figure 12:
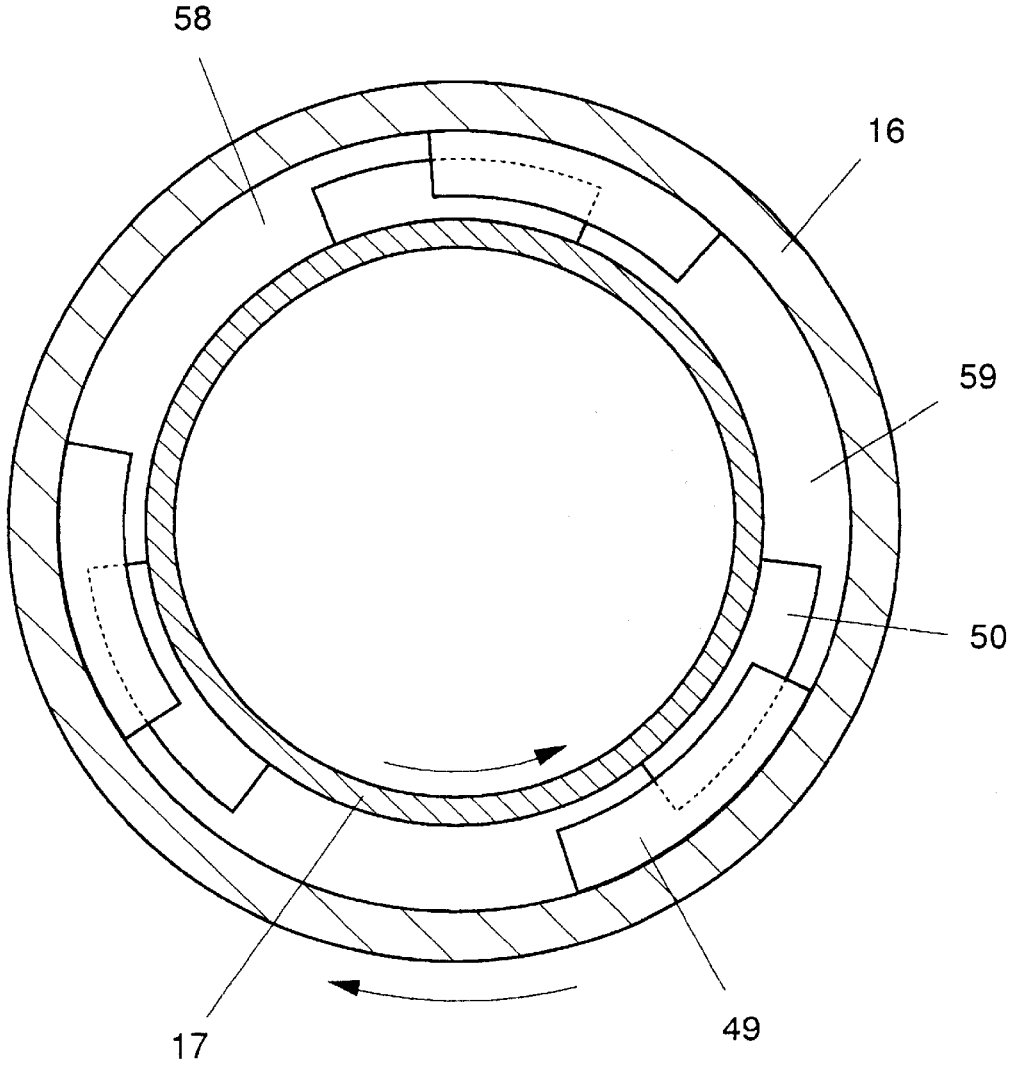
FIG. 12 is a diagrammatic sectional view of the pressure discharge device taken along a connection line at which a wrench or bayonet-type joint between the lid of the pressure discharge device and the cartridge holder is located.

The preferred wrench joint in the form of a bayonet joint is illustrated in very simplified form in FIG. 12, it being apparent that when the lid 16 is rotated in relation to the cartridge holder 17, the wrench elements 49, 50 of the components 16 and 17 are pushed or shifted so that they cover one another, and so that a formlock or formlocking connection is produced in the axial direction of the pressure discharge device 15, i.e., perpendicularly to the plane of FIG. 12 drawing. FIG. 12 shows the pressure discharge device 15 from a view oriented towards the pressure discharge device. When the lid 16 is placed on the cartridge holder 17, the wrench elements 49 are extended through the clearances 58 between the wrench elements 50, and the wrench elements 50 are extended through the clearances between the wrench elements 49 of the lid 16. The wrench elements 49, 50 are then displaced in the peripheral direction in relation to one another. It is preferable, during the rotation of the lid 16 and with the cartridge holder 17 stationary, that the wrench elements 49 of the lid 16 be displaced relative to the stationary wrench elements 50 of the cartridge holder 17. In the interest of providing an easier understanding of the function of the wrench connection 49, 50, the preferred multipartite lid 16, wherein the wrench elements 49 are formed on a bayonet disk 23 belonging to the lid 16, has been omitted from FIG. 12.

We claim:

1. An ink-supply device of a printing-machine inking unit, comprising:

a flow path for providing compressed air, said flow path having a valve;

a pressure discharge device having a cartridge holder for accepting a cartridge;

said cartridge holder having a releasable rotary joint and a lid for closing said cartridge holder, said cartridge holder to be closed by said lid through said rotary joint;

said pressure discharge device defining an internal space fluidically connected to said flow path for receiving compressed air at said internal space; and a setting device for actuating said valve when said cartridge holder is closed by a rotation of said lid and thereby of said rotary joint, said valve to be mechanically actuated in a direct manner by said setting device through the rotation of said rotary joint.

2. The ink-supply device according to claim 1, wherein said rotary joint is a wrench joint.

3. The ink-supply device according to claim 1, wherein the valve is a multiway valve switchable by the setting device into a first switching position and a second switching position.

4. The ink-supply device according to claim 2, wherein the lid has a rotatable lid disk that is a bayonet disk forming the wrench joint and provided with wrench elements.

5. The ink-supply device according to claim 1, including a venting device for venting the internal space in a third rotary position of the rotary joint, that is located between a first rotary position "completely joined" and a second rotary position "released", while the rotary joint has not yet been released.

6. The ink-supply device according to claim 5, including a safety device for preventing the rotary joint from being rotated from the third rotary position into the second rotary position for as long as the internal space remains at excess pressure.

7. The ink-supply device according to claim 1, including an air pressure-sensitive sensor for signalling a presence of excess pressure in the internal space to an electronic control device.

8. The ink-supply device according to claim 1, including an electric switch for signalling an actual switching position of the valve to an electronic control device.

9. The ink-supply device according to claim 8, wherein said electric switch is actuatable by the setting device for actuating the valve.

10. The ink-supply device according to claim 1, including a locking device for blocking rotation of the rotary joint when there is no cartridge in the cartridge holder, and for releasing rotation of the rotary joint when a cartridge is accommodated in the cartridge holder.

11. A printing machine including at least one ink-supply device having the features of claim 1.

* * * * *